US008613438B2

(12) United States Patent
Suzuki

(10) Patent No.: US 8,613,438 B2
(45) Date of Patent: Dec. 24, 2013

(54) SHEET FEEDING APPARATUS AND IMAGE FORMING APPARATUS

(75) Inventor: Tomoo Suzuki, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 55 days.

(21) Appl. No.: 13/084,738

(22) Filed: Apr. 12, 2011

(65) Prior Publication Data

US 2011/0254217 A1 Oct. 20, 2011

(30) Foreign Application Priority Data

Apr. 16, 2010 (JP) ..... 2010-094817

(51) Int. Cl.
*B65H 3/14* (2006.01)

(52) U.S. Cl.
USPC ..... 271/98; 271/97

(58) Field of Classification Search
USPC ..... 271/97, 98, 30.1
See application file for complete search history.

(56) References Cited

U.S. PATENT DOCUMENTS

| | | | | |
|---|---|---|---|---|
| 5,150,892 | A * | 9/1992 | Shimizu | 271/98 |
| 5,181,711 | A * | 1/1993 | Spoorenberg | 271/98 |
| 5,716,046 | A * | 2/1998 | Katamoto et al. | 271/3.08 |
| 5,915,683 | A * | 6/1999 | Otsuka | 271/94 |
| 6,412,769 | B1 * | 7/2002 | Goda et al. | 271/94 |
| 7,708,264 | B2 * | 5/2010 | Kosugi et al. | 271/97 |
| 7,740,240 | B2 * | 6/2010 | Iwakiri | 271/97 |
| 2009/0121411 | A1 * | 5/2009 | Kosugi et al. | 271/97 |

FOREIGN PATENT DOCUMENTS

| | | | |
|---|---|---|---|
| JP | 10-226436 | A | 8/1998 |
| JP | 2000-198557 | A | 7/2000 |
| JP | 2001010738 | A | 1/2001 |
| JP | 2009113970 | A | 5/2009 |

OTHER PUBLICATIONS

Notice of Reasons for Refusal for Japanese Application No. 2010-094817; Date of Drafting: Oct. 10, 2013, with English Translation.

* cited by examiner

*Primary Examiner* — Kaitlin Joerger
*Assistant Examiner* — Ernesto Suarez
(74) *Attorney, Agent, or Firm* — Cantor Colburn LLP

(57) ABSTRACT

A sheet feeding apparatus includes: a loading platen on which sheets are loaded, an air blowing section which blows air to sides of a loaded sheet bundle loaded on the loading platen, and an adsorption/conveyance mechanism which adsorbs and conveys a sheet, a driving section moving the loading platen up and down, wherein the air blowing section includes a plurality of air blowing openings facing both sides of the loaded sheet bundle and blowing air to the both sides, wherein each of the plurality of air blowing openings is formed so that a first air flow flows above the loading platen and a second air flow flows below the loading platen when the loading platen reaches a highest position by the driving section, and wherein the loading platen is provided with a penetration thorough which the second air flow flows from below to above the loading platen.

8 Claims, 11 Drawing Sheets

SHEET FEEDING APPARATUS AND IMAGE FORMING APPARATUS

RELATED APPLICATION

This application is based on Japanese Patent Application NO. 2010-094817 filed on Apr. 16, 2010 in Japanese Patent Office, the entire content of which is hereby incorporated by reference.

BACKGROUND

1. Field of the Invention

The present invention relates to a sheet feeding apparatus for feeding sheets one by one from a plurality of loaded sheets, and an image forming apparatus provided with this sheet feeding apparatus.

2. Description of Related Art

A photocopier, printer, printing press and such related devices have been using a sheet feeding apparatus wherein multiple sheets loaded on a sheet feed platen are fed one by one by a sheet feed roller. The sheet feeding apparatus using a sheet feed roller is accompanied by problems wherein non-feed failure is caused by the slipping of the sheet feed roller or, depending on the paper quality or environment, multiple sheet feeding failures occur such that multiple sheets sticking to each other are fed out. Further, with the progress of wear on the sheet feed roller, such a sheet feed failure becomes serious. One of the biggest current requirements is to find out how to solve these problems resulting from the spreading of the use of photocopiers and printers, an increase in the type of sheets to be used, and an enhanced feed speed.

In an effort to solve the aforementioned problems, attention is currently focused on a sheet feeding apparatus known under the name of a pneumatic sheet feeding apparatus, wherein sheets are floated by blowing of air, and the floated sheets are adsorbed by an adsorption/conveyance mechanism, whereby these sheets are individually separated and are then fed out. In the pneumatic sheet feeding apparatus, air is blown to the side of a bundle of loaded sheets so that the sheets are floated. The topmost one of the floated sheets is adsorbed and conveyed by the adsorption/conveyance mechanism. When air is blown to the lateral portion of the sheets, air enters between sheets until a sufficient layer of air is formed. This ensures the effective separation of sheets into one sheet and positive sheet feeding at a high speed.

The pneumatic sheet feeding apparatus, however, has come across a new problem wherein the sheets cannot be adsorbed by the adsorption/conveyance mechanism due to the failure of the sheets being floated sufficiently close to the position of the final sheet, wherein the residual number of sheets is drastically reduced, when the sheets stacked on the tray are sequentially fed. The following describes this problem with reference to FIG. 13.

In FIG. 13, the airflow V1 is blown to the side of the loaded sheet bundle loaded on the loading platen 70, and the sheets are floated. When the sheet P1 in the topmost position of the loaded sheet bundle has reached the level L, the adsorption/conveyance mechanism 60 adsorbs and conveys the sheet P1. For the adsorption/conveyance mechanism 60 to adsorb the sheet P1, the sheet P1 must be floated from the lower side as an adsorption surface of the adsorption/conveyance mechanism 60 to the level L having a prescribed interval.

In the meantime, the loading platen 70 is controlled so that the sheet P1 of the topmost position is constantly located at a prescribed height. Then, when there are not many sheets remaining on the loading platen 70, the loading platen 70 spans the air blowing opening 44 forming the airflow V1, in the vertical direction. This will result in a decrease in the amount of airflow V1 blown into the clearance of the loaded sheets, especially in the amount of air blown into the lower side of the sheet P1 in the topmost position. Thus, the sheet floating power is reduced. Accordingly, the sheet P1 in the topmost position fails to float up to a prescribed level L, and adsorption failure occurs to the adsorption/conveyance mechanism 60, with the result that no-feed failure takes place. Various forms of measures have been taken to solve this problem in the conventional art.

The Unexamined Japanese Patent Application Publication No. Hei 10 (1998)-226436, discloses a pneumatic sheet feeding apparatus wherein air is blown to the leading edge of the loaded sheets by means of a blowing unit, and the sheet in the topmost position is adsorbed and conveyed by means of an adsorption unit. In this pneumatic sheet feeding apparatus, a rib extending in the sheet conveying direction is provided on a sheet platen, and air is fed in the clearance formed between the sheets and sheet platen so that sheets are floated.

The Claim 5 and FIG. 6 of the Unexamined Japanese Patent Application Publication No. 2000-198557, show a pneumatic sheet feeding apparatus provided with a fan for blowing air to the leading edge of the sheets, and a final sheet blowing fan for blowing air to the lower side of the sheet from below.

The Unexamined Japanese Patent Application Publication No. Hei 10 (1998)-226436, is effective for the sheet having up to a prescribed level of basis weight. However, this is not effective for the sheet of extra heavy weight as exemplified by an A3-sized paper having a basis weight of 300 g/m$^2$. To be more specific, when air is blown from the leading edge of the sheet, the greater part of air goes to the space above the sheet rather than the clearance formed between the rib and sheet. Even if the air volume is increased and a certain amount of air enters the clearance between the rib and sheet, the air sucked from one of the end faces to the point below the sheet in the topmost position flows directly to the end face on the opposite side. The effective buoyancy for raising the sheets to the adsorption unit cannot be gained, even if sheets are floated slightly. Thus, a heavy sheet cannot be floated.

The Unexamined Japanese Patent Application Publication No. 2000-198557 is effective for the sheet having a certain basis weight. For the sheet of extra heavy weight as exemplified by an A3-sized paper having a basis weight of 300 g/m$^2$, a large-sized final sheet blowing fan must be used to generate a considerable amount of air pressure. This fan must be installed below the sheet loading section. This will increase the overall dimensions of the apparatus. A large-sized fan is required only to float the final sheet, and this leads to a cost increase.

SUMMARY

The present invention is intended to solve the aforementioned problems with the conventional pneumatic sheet feeding apparatus. It is accordingly an object of this invention to provide a sheet feeding apparatus and image forming apparatus of a compact configuration and reduced cost that ensures sheets to be adsorbed positively by an adsorption/conveyance unit despite a smaller number of sheets on a loading platen, and permits sheets to be supplied on a stable basis.

To achieve at least one of the abovementioned objects, a sheet feeding apparatus reflecting one aspect of the present invention comprises: a loading platen on which a sheet is loaded, an air blowing section which blows air to sides of a loaded sheet bundle loaded on the loading platen, an adsorption/conveyance mechanism which adsorbs and conveys a top most sheet of sheets floated by air flow blown by the air blowing section, and a driving section moving the loading platen up and down, wherein the air blowing section includes a plurality of air blowing openings facing both sides of the loaded sheet bundle and blowing air to the both sides, wherein each of the plurality of air blowing openings is formed so that a first air flow flows above the loading platen and a second air flow flows below the loading platen when the loading platen reaches a highest position by the driving section, and wherein the loading platen is provided with a penetration thorough which the second air flow flows from below to above the loading platen.

Further a sheet feeding apparatus reflecting another aspect of the present invention comprises: a loading platen on which a sheet is loaded, an air blowing section which blows air to sides of a loaded sheet bundle loaded on the loading platen, an adsorption/conveyance mechanism which adsorbs and conveys a top most sheet of sheets floated by air flow blown by the air blowing section, and a driving section moving the loading platen up and down, wherein the air blowing section includes a plurality of air blowing openings facing both sides of the loaded sheet bundle and blowing air to the both sides, and wherein a rib is formed at each position of the plurality of air blowing openings from where the first air flow flows out, on an upper surface of the loading platen.

DESCRIPTION OF THE PREFERRED EMBODIMENTS

Figure 1:
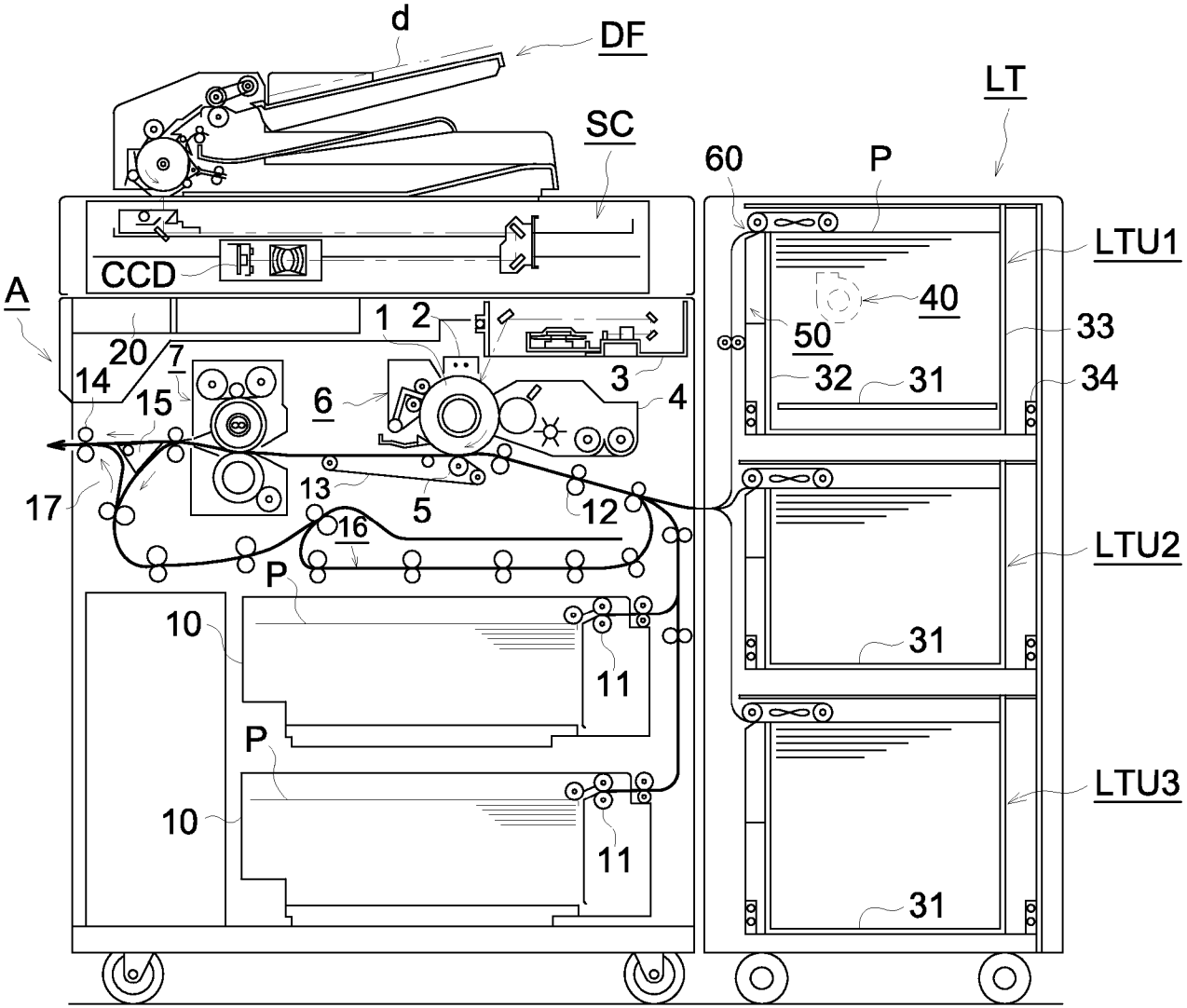
FIG. 1 is a diagram representing the overall configuration of the image forming apparatus in an embodiment of the present invention.

Referring to the drawings, the following describes the embodiments of the present invention, without the present invention being restricted thereto.

<Image Forming Apparatus>

FIG. 1 shows an overall configuration of the image forming apparatus including an image forming apparatus main body A, image reading apparatus SC, automatic document feeder DF and high-volume sheet feeding apparatus LT.

The illustrated image forming apparatus main body A is provided with an image forming section including a photoreceptor (image carrier) 1, charging unit 2, image exposure device 3, development device 4, transfer unit 5, cleaning unit 6, fixing apparatus 7 and sheet conveying system.

The sheet conveying system includes a first sheet feed unit 11, second sheet feed unit 12, sheet ejection unit 14, conveying route switching unit 15, circulating sheet re-feed unit 16, and reversing sheet ejection unit 17. Sheets P are fed to the image forming section from two sheet feeding cassettes 10 by means of the first sheet feed unit 11.

The document "d" loaded on the document platen of the automatic document feeder DF is conveyed by the sheet feed unit, and the image on one side or both sides of the document "d" is read by the optical system of the image reading apparatus SC. The image is then read by an image sensor CCD. The analog signal having been subjected to photoelectric conversion by the image sensor CCD undergoes analog processing, analog-to-digital conversion, shading correction, image compression and other related processing in the image processing section 20. After that, the image signal is sent to the image exposure device 3.

Such processing as charging, exposure, development, transfer, separation and cleaning is performed in the image forming section.

In the image forming section, the photoreceptor 1 is provided with electric charging (negative charging in this embodiment) by the charging unit 2. The electrostatic latent image is formed by application of laser by the image exposure device 3. The electrostatic latent image is developed by the development device 4 and is formed into a toner image (negatively charged in the present embodiment). In the meantime, the sheets P accommodated in the sheet feeding cassette 10 are conveyed from the first sheet feed unit 11. The sheets P are synchronized with the toner image by the second sheet feed unit 12 made up of a registration roller and are conveyed. After that, the toner image is transfer to the sheet P by the transfer unit 5, and the toner image transferred to the sheet P is fixed in position by the fixing apparatus 7.

The sheet P having been fixed in position is ejected out of the apparatus by the sheet ejection unit 14. In the meantime, the toner remaining on the photoreceptor 1 subsequent to the transfer process is removed by the cleaning unit 6. In the case of duplex printing, the sheet P with an image formed on the first surface is fed to the circulating sheet re-feed unit 16, and is reversed. Again in the image forming unit, an image is formed on the second surface. After that, the sheet P is ejected out of the apparatus by the sheet ejection unit 14. In the reverse ejection mode, the sheet P having been branched off from the regular sheet ejection passage is switched back by the reversing sheet ejection unit 17, and is reversed. After that, the sheet P is ejected out of the apparatus by the sheet ejection unit 14.

The image forming apparatus main body A is connected with the high-volume sheet feeding apparatus LT. The high-volume sheet feeding apparatus LT has three-tiered sheet feed units LTU1, LTU2 and LTU3. Each of the sheet feed units LTU1, LTU2 and LTU3 includes a first air blowing section 40, second air blowing section 50, and adsorption/conveyance mechanism 60. Accommodating a great number of sheets P, each of the sheet feed units feeds the sheets P one by one to the image forming apparatus main body A.

Embodiment 1

Figure 2:
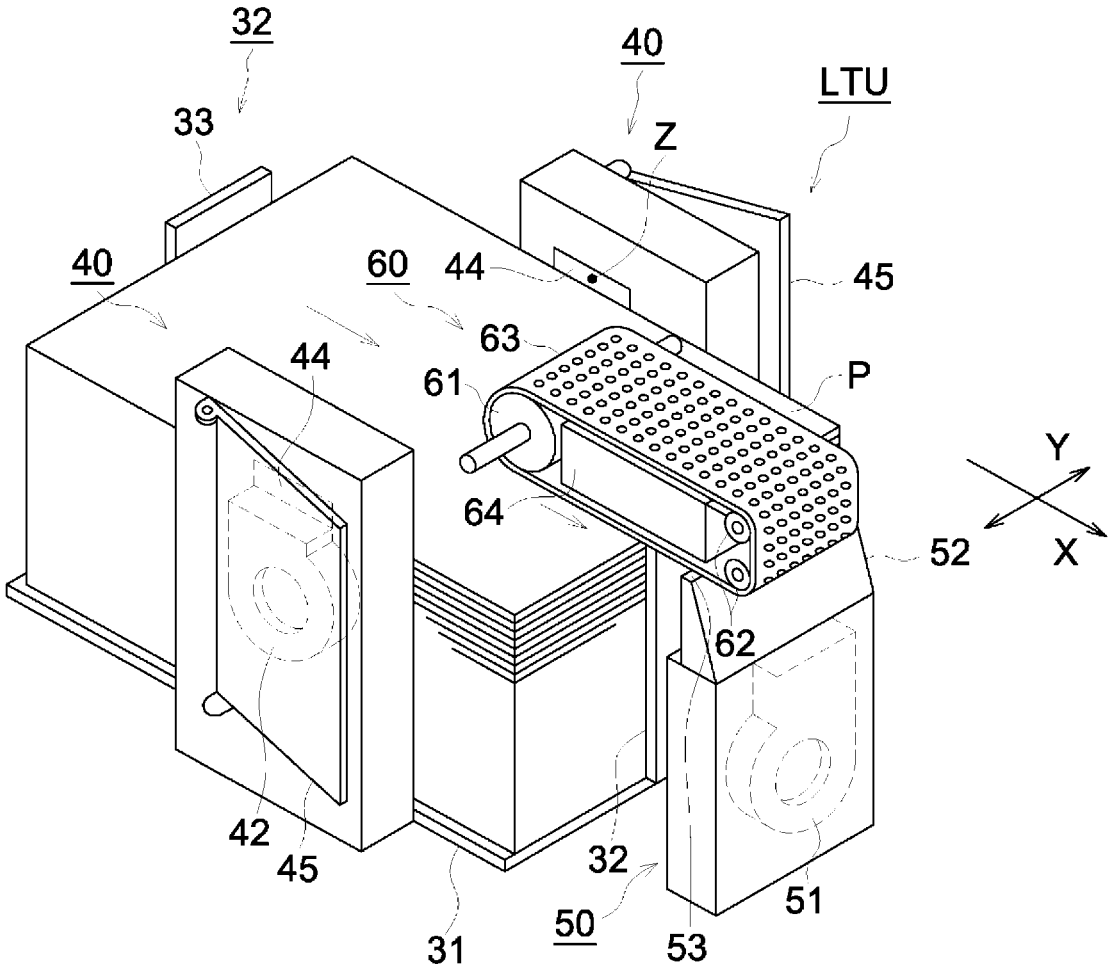
FIG. 2 is a perspective view of a sheet feed unit as a sheet feeding apparatus in the first embodiment of the present invention.
Figure 3:
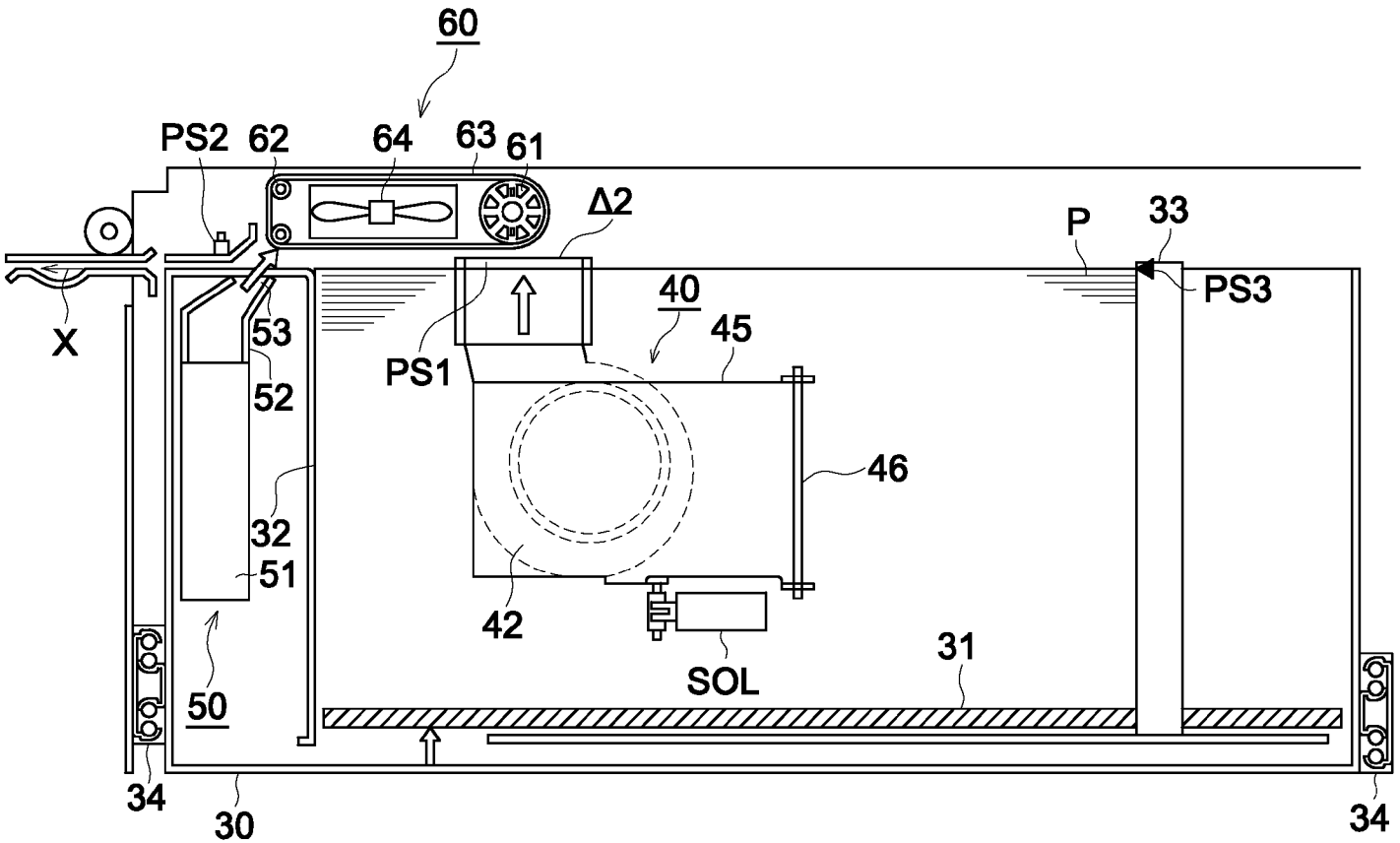
FIG. 3 is a front view in the cross section of a sheet feed unit.
Figure 4:
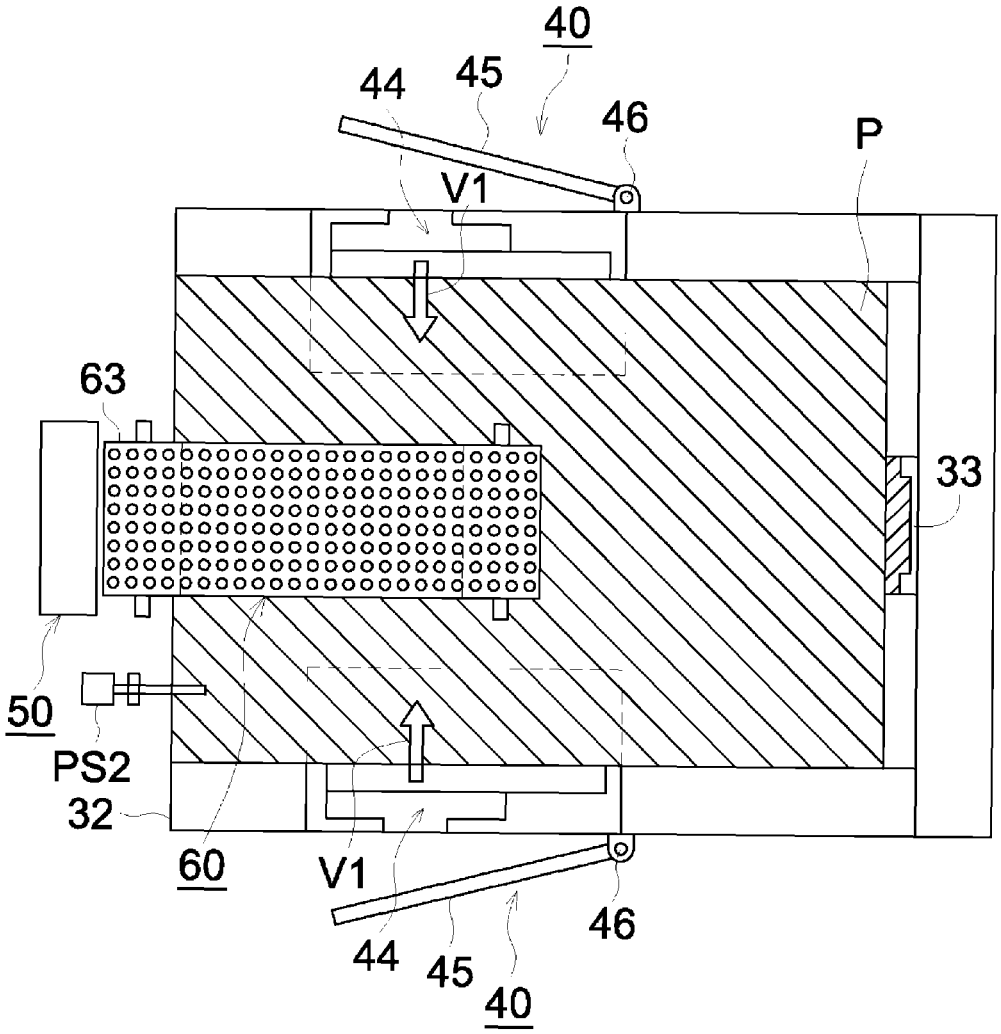
FIG. 4 is a plan view of the sheet feed unit.
Figure 5:
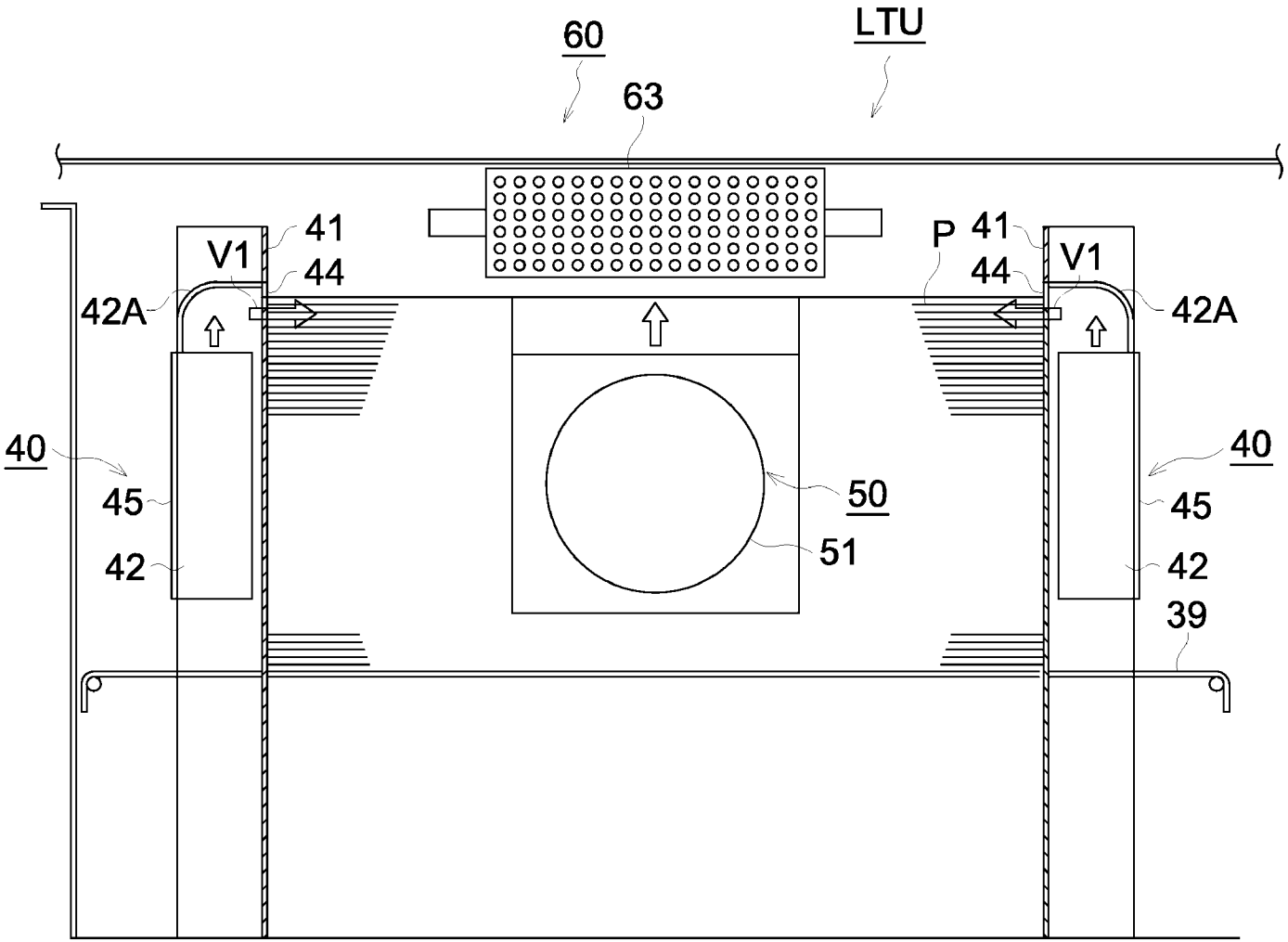
FIG. 5 is a cross sectional view of the sheet feed unit.

FIG. 2 is a perspective view of a sheet feed unit constituting a high-volume sheet feeding apparatus as a sheet feeding apparatus in the first embodiment of the present invention. FIG. 3 is a front view in the cross section of a sheet feed unit. FIG. 4 is a plan view of the sheet feed unit. FIG. 5 is a cross sectional view of the sheet feed unit. FIGS. 2 through 5 show the sheet feed units LTU1, LTU2 and LTU3 in terms of LTU.

In these diagrams, the sheets P having been stacked are loaded on the loading platen 31 and are accommodated movably in the vertical direction by the elevating mechanism (not illustrated). The first air blowing section 40 as an air blowing section is mounted movably across the width (indicated by arrow Y) perpendicular to the sheet P conveying direction indicated by arrow X, and is provided with a lateral edge regulating member 41 (to be described later) which lightly taps both sides of the sheet Pin response to the width of the stacked sheets P, whereby the positions of both sides of the sheet P are regulated. The leading edge regulating member 32 regulates the position of the leading edge of the sheets P in the direction of conveyance (indicated by arrow X). The trailing edge regulating member 33 is mounted movably in the longitudinal direction along the sheet P conveying direction (indicated by arrow X) and regulates the position of the trailing edge of the sheets P in the direction of conveyance.

As shown in FIG. 3, the trailing edge regulating member 33 is provided with the upper limit sensor PS3 for detecting the height of the sheets P close to the topmost position.

To maintain the height of the sheet bundle stacked on the loading platen 31 at the level best suited to air blowing and sheet adsorption, the control section (to be described later) performs the commonly known control operation of driving the motor (to be described later) as a drive section, based on the result of detection by the upper limit sensor PS3, whereby the loading platen 31 is moved in the vertical direction.

An adsorption/conveyance mechanism 60 is installed close to the trailing edge of the sheet P in the direction of conveyance. The adsorption/conveyance mechanism 60 has an adsorption belt 63 that rotates and is wound with a large roller 61 connected to a drive source (not illustrated) and two small rollers 62. The adsorption belt 63 is provided with multiple small-diameter penetrations. An adsorption unit 64 is mounted inside the adsorption belt 63, which adsorbs and conveys the sheet P.

When the adsorption belt 63 rotates adsorbing the sheets P, the sheets P in the topmost position of the sheet bundle loaded on the loading platen 31 are fed in the X-marked direction of the drawing to reach the image forming apparatus main body A.

The sheet adsorption detecting sensor PS1 located close to the adsorption surface of the adsorption belt 63 detects that the topmost surface of the sheet P has been adsorbed. The sheet adsorption sensor PS1 has an actuator hanging down from a plurality of adsorption belts 63. When the sheet P has been adsorbed, the actuator is lifted and sensor PS1 detects that the sheet P has been adsorbed.

The feed sensor PS2 mounted close to the adsorption belt 63 on the downstream side in the sheet conveying direction of the loading platen 31 detects the passage of the sheets P to be fed.

Close to the adsorption belt 63 on the downstream side in the sheet conveying direction of the loading platen 31, the second air blowing section 50 is fixed to the sheet feeding apparatus main body 30. The second air blowing section 50 is made of a fan and others. It should be noted that the second air blowing section 50 can be mounted on the sheet feeding apparatus main body 30 to send air to the leading edge of the loaded sheet bundle through a duct.

The fan 51 of the second air blowing section 50 is installed with the air blowing opening 53 facing upward. The direction of upwardly blown air is changed by a guide plate 52, and the air is blasted upwardly in a slanting direction from the air blowing opening 53. Thus, the air is blown to the vicinity close to the downstream side the adsorption belt 63 of the adsorption/conveyance mechanism 60.

As shown in FIG. 2 and FIG. 5, the first air blowing sections 40 are provided on both lateral surfaces of the loading platen 31. These first air blowing sections 40 are air blowing sections for blowing air to the top of the sheets P stacked on the loading platen 31 from the side perpendicular to the sheets P conveying direction. As shown in FIG. 5, the first air blowing section 40 blows air flow V1 to the side of the loaded sheet bundle including multiple sheets. The first air blowing section 40 is equipped with a fan 42 that blows air to the top of the sheets P from the air blowing openings 44 on both sides across the width of the sheets P (indicated by arrow Y). As shown in FIGS. 2 and 4, in conformity to the adsorption/conveyance mechanism 60, the air blowing opening 44 is arranged below the adsorption/conveyance mechanism 60 to blow air to the side of the loaded sheet bundle including sheets P.

The first air blowing section 40 is provided with a lateral edge regulating member 41. The fan 42 is mounted with the outlet facing upward. Part of the fan 42 is made of a lateral edge regulating member 41. The air blowing opening 44 has an air blowing opening close to the top end of the lateral edge regulating member 41 to allow the direction of the upwardly blown air to be changed by 90 degrees by the outlet forming member 42A of the fan 42, and to ensure formation of an air flow V1 that is blown from the air blowing opening 44 approximately in the horizontal direction. The width of the air blowing opening 44 is approximately the same as the width of the outlet of the first air blowing section 40. In a preferred positional relationship, the sheet P of the topmost position should come approximately at the mid-position between the top and bottom ends of the air blowing opening 44, namely, between the outlet forming member 42A and the top end of the lateral edge regulating member 41. The first air blowing section 40 has a lateral edge regulating member 41 integrally built with the same. The first air blowing section 40 can be moved together by the movement of the lateral edge regulating member 41, when there is a change in the size of the sheet P. It should be noted that the first air blowing sections 40 are provided on both sides of the sheet P in the present embodiment. However, the first air blowing section 40 can be provided only on one side.

When the first air blowing section 40 has been operated, air is ejected from the air blowing opening 44, and is blown to several sheets P located on the upper portion of the loaded sheet bundle. The air passes through the sheets from one end of the sheets P to proceed to the other ends. These several sheets P on the upper portion are separated into each sheet and are floated. The adsorption/conveyance mechanism 60 absorbs only the sheet P1 in the topmost position out of the sheets P having been separated, and feeds the sheets P1 downward.

As shown in FIGS. 2 and 3, the air inlet of the first air blowing section 40 is shielded by the shielding unit and can be opened or closed as desired. To put it another way, the shielding member of the shielding unit (shutter) 45 is supported by a shaft 46, and is opened or closed by a solenoid SOL. The control section controls the open/close operation of the shielding member 45, and switches between start and suspension of air blowing operation by the first air blowing section 40.

Figure 6A:
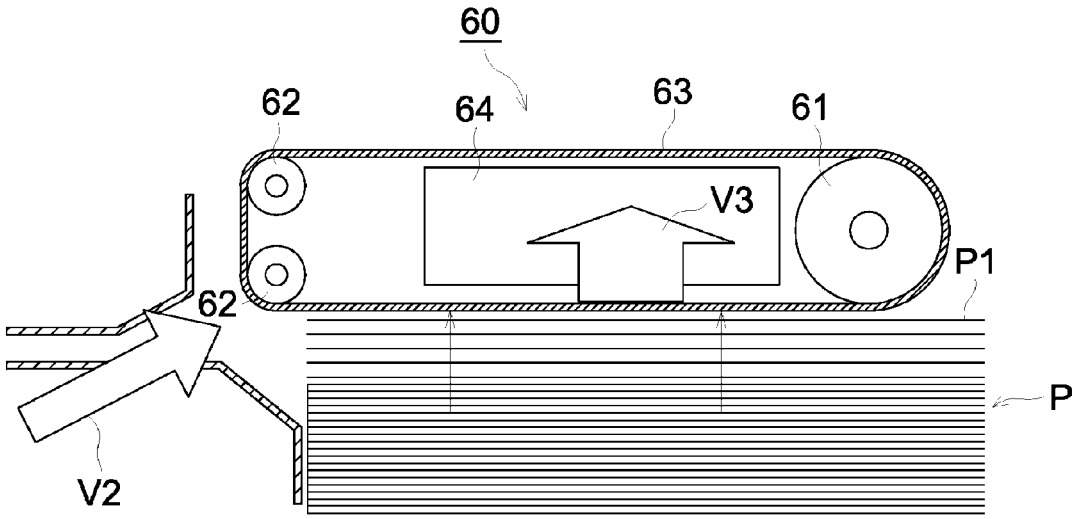
FIGS. 6*a* and 6*b* are cross sectional views showing the process of sheet adsorption and conveyance by a first air blowing section 40 and the second air blowing section 50.
Figure 6B:
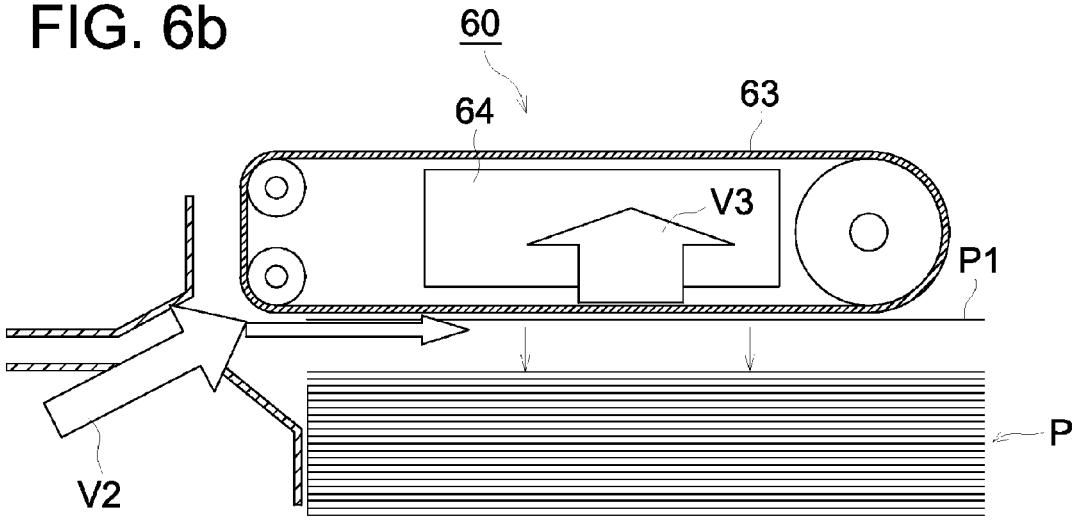

FIGS. 6*a* and 6*b* are cross sectional views showing the process of sheet adsorption and conveyance by the first air blowing section 40 and the second air blowing section 50.

FIG. 6*a* shows the process of adsorption. A small number of sheets P on the upper portion of the loaded sheet bundle stacked on the loading platen 31 are lifted by the air flow V1 (white-out arrow in FIGS. 4 and 5) blown upward by the first air blowing section 40 against the dead weight of the sheets P, and are adsorbed by the intake air V3 (indicated by the white-out arrow of the drawing) under the negative pressure of the adsorption belt 63. As will be described later, the air flow V1 is blown to the side of the sheet P. Air passes through sheets P constituting the loaded sheet bundle to separate and float the sheets P. The air flow V2 (white-out arrow of the drawing) blown upward by the second air blowing section 50 is blown close to the vicinity of the forward bottom of the adsorption belt 63.

FIG. 6*b* illustrates the sheet separation process for separating the sheet P1 in the topmost position. When the shielding member 45 shields the air inlet of the first air blowing section 40 to suspend air blowing, air blown only by the second air blowing section 50 flows through the sheet P1 on the topmost position and the sheet P below. The sheet P1 in the topmost position is adsorbed by the intake air V3 of the adsorption/conveyance mechanism 60, and air flow V2 from the second air blowing section 50 is blown to the leading edge of the sheet P. Accordingly, the sheet P1 in the topmost position is separated from the sheet P below by air pressure of air flow V2. The sheets P below the sheet P1 in the topmost position having been separated by air flow V2 are lowered under its own weight in the arrow-marked direction and are converged with the loaded sheet bundle.

As described above, after the sheet P has been floated by the operation of the first air blowing section 40 and second air blowing section 50, the sheet P is adsorbed by the adsorption/conveyance mechanism 60. Then the operation of the first air blowing section 40 is suspended and the operation of the second air blowing section 50 is continued, so that the sheet P1 in the topmost position is conveyed. This process of floating, adsorption and conveyance is repeated until the floating of the several sheets P of the loaded sheet bundle is spread over almost the entire surfaces of the sheets P in the air blowing opening 44, and almost the same clearance is reached between the sheets. Air then passes through the clearance. This procedure enhances the separability of the sheet P1 and facilitates feeding of the sheet P1. This process of sheet adsorption and conveyance solves the problems wherein the sheet is damaged by excessive floating of the sheet P1 or separation failure is caused by floating of a plurality of sheets sticking with one another.

Figure 7:
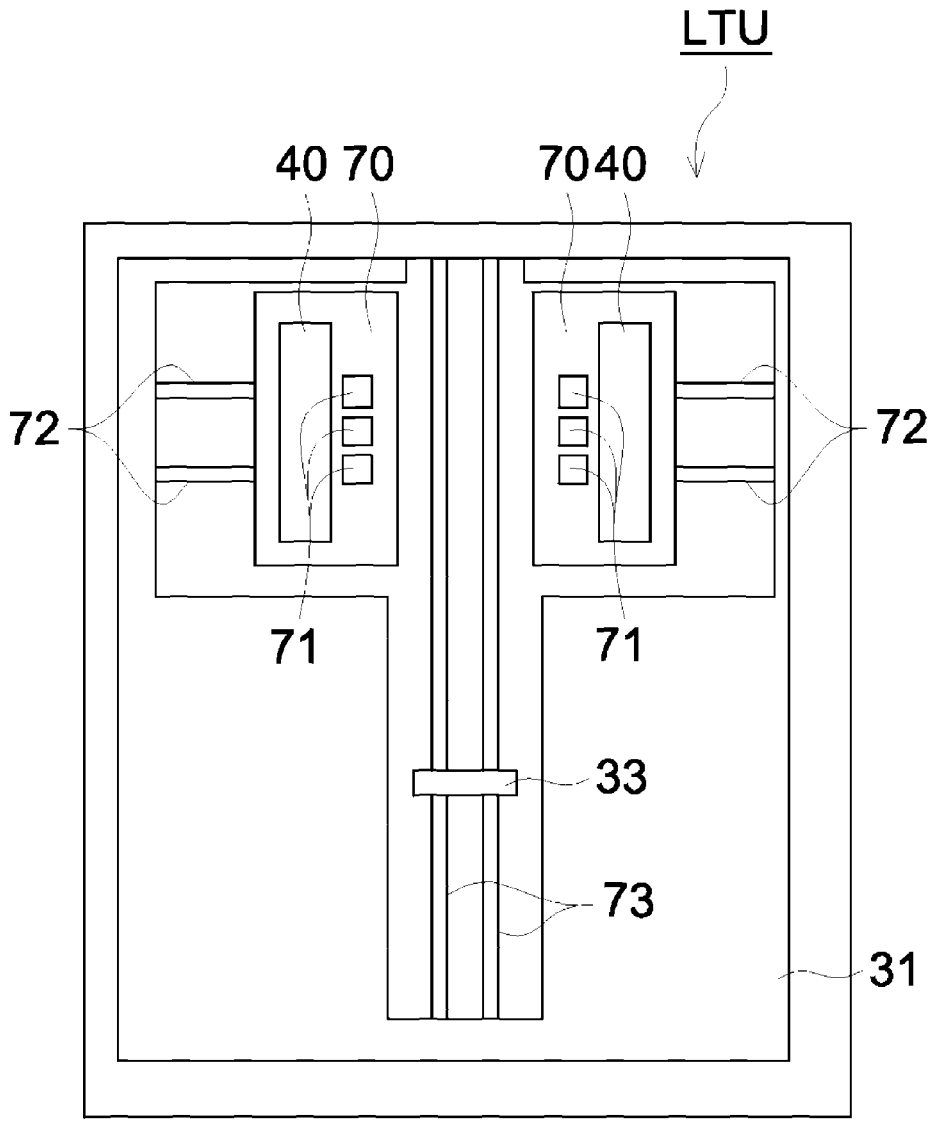
FIG. 7 is a plan view of a sheet feed unit LTU without a sheet being accommodated therein.

Referring to FIGS. 7 through 9, the following further describes the sheet P floated by air flow V1.

Figure 8A:
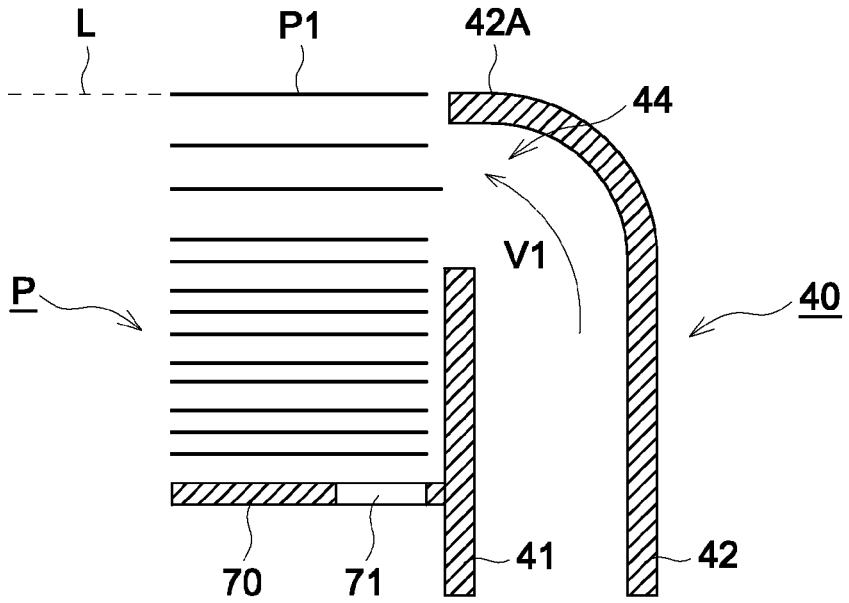
FIGS. 8*a* and 8*b* are vertical sectional views along the arrow Yin point Z of FIG. 2.
Figure 8B:
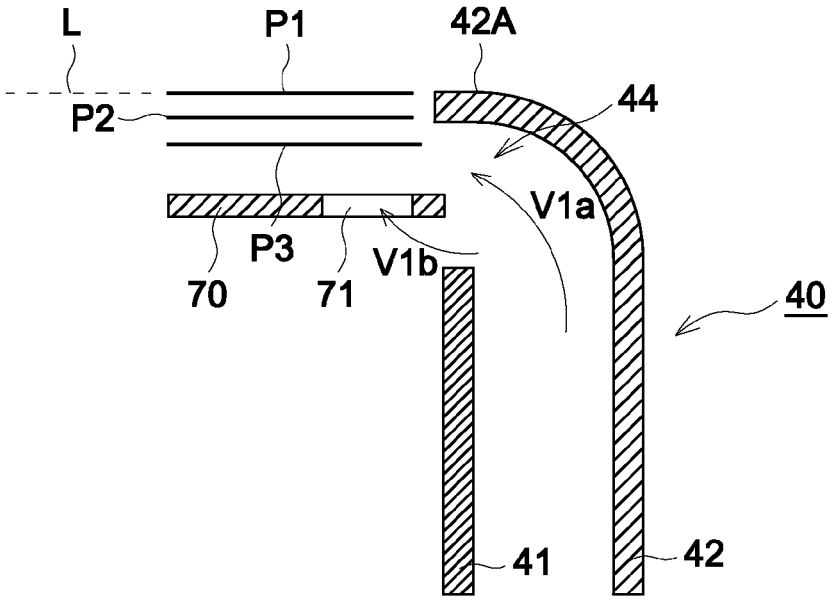
Figure 9A:
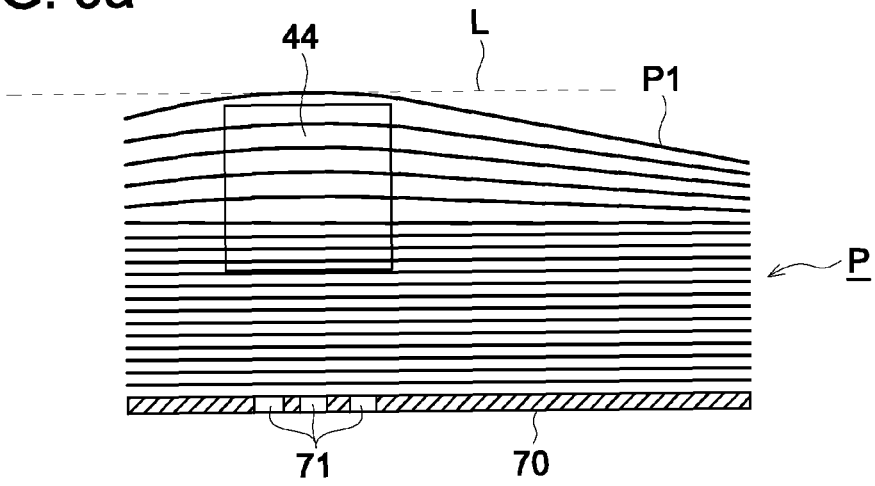
FIGS. 9*a* and 9*b* are vertical sectional views along the arrow X in point Z of FIG. 2.
Figure 9B:
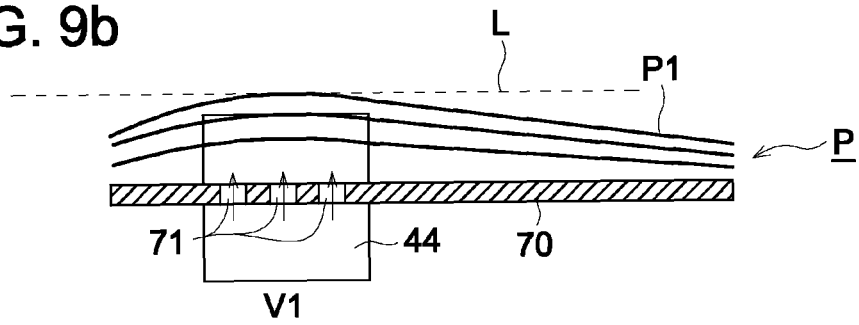

FIG. 7 is a plan view of a sheet feed unit LTU without a sheet being accommodated therein. FIGS. 8*a* and 8*b* are vertical sectional views along the arrow Y in point Z of FIG. 2. FIGS. 9*a* and 9*b* are vertical sectional views along the arrow X in point Z of FIG. 2. FIG. 8*a* and FIG. 9*a* are schematic diagrams showing the sheet P floating when multiple sheets P are loaded on the loading platen 70, whereas FIG. 8*b* and FIG. 9*b* are schematic diagrams showing the sheet P floating when a small number of sheets P are loaded on the loading platen 70.

The loading platen 70 supports the sheet P at the air blowing opening 44 for the air flow V1 that is blown to the lateral edge of the sheet P. The leading edge of the sheet P is supported by the loading platen 70, and the portion of the sheet P following the leading edge is supported by the loading platen 31. Each loading platen 70 is formed integral with two lateral edge regulating members 41, and can be moved in the lateral direction when guided by the guiding rod 72. The loading platen 70 is provided with a penetration 71.

The trailing edge regulating member 33 is guided by the guiding rod 73, and can be moved in the vertical direction of FIG. 7, namely, in the sheet conveyance direction. The lateral edge regulating member 41 and trailing edge regulating member 33 are moved manually or automatically in response to the size of the sheet P loaded on the sheet feed unit LTU.

The first air blowing section 40 has a lateral edge regulating member 41 for regulating the lateral edge of the sheet P and a fan 42. The port 44 is made of the outlet forming member 42A of the fan 42 and the lateral edge regulating member 41.

In FIG. 8*a* and FIG. 9*a* wherein multiple sheets P are stacked on the loading platen 70, the loading platen 70 is located below the air blowing opening 44, and the air flow V1 of the fan 42 is blown to the side of the loaded sheet bundle from the air blowing opening 44.

Air flow V1 enters each of the clearances formed between sheets P constituting the loaded sheet bundle. As a result, a pneumatic layer is formed between the sheets P. Multiple sheets P are separated by the pneumatic layer and are placed one on top of another. Then each sheet P is floated, separated from others.

The sheets P1 in the topmost position reaches the level L, and the intake air V3 (FIG. 6*a* and FIG. 6*b*) acts on the sheet P1. The sheet P1 is then adsorbed by the adsorption/conveyance mechanism 60.

When the number of sheets P on the loading platen 70 has been reduced to a very small level, the loading platen 70 rises to the height of the air blowing opening 44, as shown in FIG. 8*b* and FIG. 9*b*. In the state shown in FIG. 8*b* and FIG. 9*b*, the loading platen 70 is so placed as to span the air blowing opening 44 in the vertical direction. Thus, the air flow of the fan 42 is divided into the first air flow V1*a* and second air flow V1*b*.

The first air flow V1*a* goes above the loading platen 70, and is blown to the lateral edge of the sheet P. This air passes through sheets P to float the sheets P. The second air flow V1*b* goes below the loading platen 70. Part of this flow passes through the penetration 71 to go above the loading platen 7. This flow is blown to the bottom of the final sheet P3 in the lowest position so that the final sheet P3 on the lowest position floats.

Further, since the penetrations 71 are arranged on both opposed sides, air flows having been blown collide with each other close to the center of the sheet. This causes positive pressure below the sheet so that the portion close to the center of the final sheet P3 is effectively floated. If the adsorption belt 63 is placed in the position wherein the sheet is floated at a greater height, namely, in the region above the region of a straight line connecting between the two opposed outlets 44, more positive adsorption and conveyance of the sheet is ensured.

As illustrated, the final sheet P3 is floated at a greater height by the second air flow V1*b*, and sheets P1 and P2 are floated by the first air flow V1*a*.

In the absence of a penetration 71, when a small number of sheets P are loaded on the loading platen 70 as shown in FIG. 8*b* and FIG. 9*b*, air is blown from the ventilation port 44 having a small area restricted by the loading platen 70 and the upper edge of the air blowing opening 44. Accordingly, only a small amount of air is blown to the sheet P, with the result that the level L1 required to adsorb the sheet P1 by the adsorption/conveyance mechanism 60 may not be reached. This may cause a sheet feed failure.

The loading platen 70 is provided with penetrations 71. When there is a reduction in the number of the sheets P loaded on the loading platen 70, the final sheet P3 in the lowest position is floated by the second air flow V1*b*. This procedure allows the sheet P1 in the topmost position to be floated up to the level L1, and ensures the sheet P1 to be adsorbed by the adsorption/conveyance mechanism 60, with the result that the problem of sheet feed failure has been eliminated.

Figure 10:
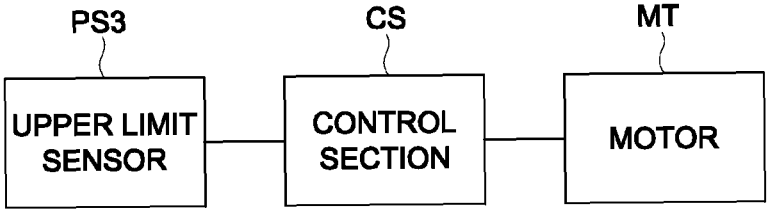
FIG. 10 is a block diagram of a control system.

FIG. 10 is a block diagram of a control system.

When the sheets are consumed by image formation and the amount of the loaded sheet bundle has been reduced, the control section CS allows the motor MT as a drive section to be operated, based on the detection signal of the upper limit sensor PS3, to ensure that the upper side of the loaded sheet bundle is always kept at a prescribed level. Thus, the loading platens 31 and 70 are raised. The top position of the loading platen 70 is shown in FIG. 8*b* and FIG. 9*b*. In FIG. 8*b* and FIG. 9*b*, the loading platen 70 is located at the mid-position of the air blowing opening 44. Air flow from the first air blowing section 40 is divided into the first air flow V1*a* going above the loading platen 70 and the second air flow V1*b* going below the loading platen 70. The second air flow V1*b* passes through the penetration 71 and goes above the loading platen 70, whereby the final sheet P3 in the lowest position is pushed upward.

Embodiment 2

Figure 11:
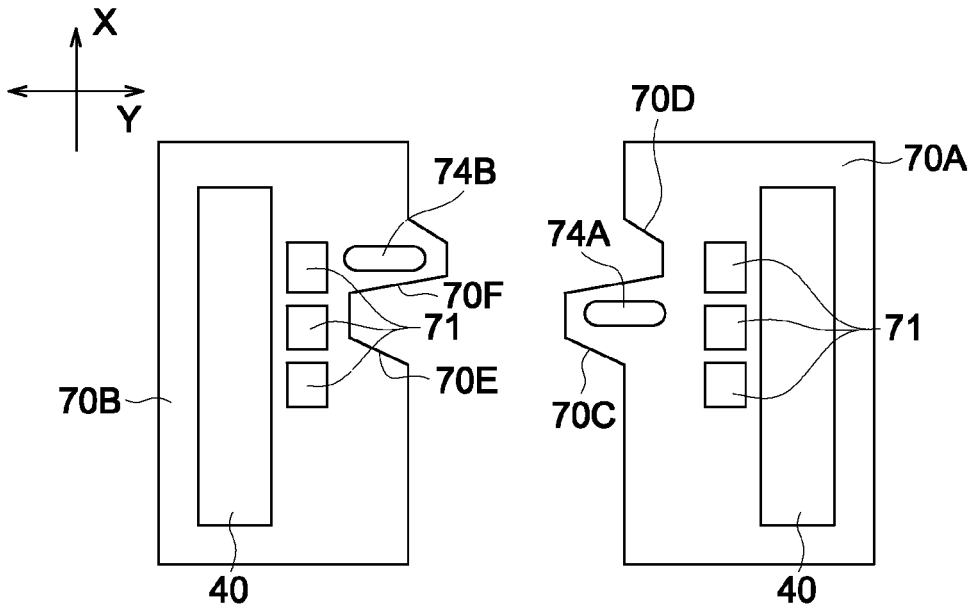
FIG. 11 is a diagram showing the loading platen 70 in the sheet feeding apparatus of the second embodiment of the present invention.

FIG. 11 is a diagram showing the loading platen in the sheet feeding apparatus of the second embodiment of the present invention. The second embodiment is the same as that first invention except for the loading platen.

The loading platen corresponding to the loading platen 70 of FIG. 7 is made up of two loading platens 70A and 70B. Each platen is formed integral with the first air blowing section 40. The loading platens 70A and 70B are provided with penetrations 71.

The convex portion 70C and concave portion 70D are formed on the loading platen 70A. The concave portion 70E and convex portion 70F are formed on the loading platen 70B. The loading platens 70A and 70B move across the width (indicated by arrow Y) in conformity to the size of the sheet. When the loading platen 70A has come close to the loading platen 70B for the sheet of a smaller size, the convex portion 70C is fitted into the concave portion 70E, and the convex portion 70F is fitted into the concave portion 70E. The convex portion 70C is provided with a rib 74A, and the convex portion 70F is equipped with a rib 74B. The ribs 74A and 74B are formed opposed to the air blowing opening 44, and the air flow V1 from the air blowing opening 44 goes above the ribs 74A and 74B. The ribs 74A and 74B extend from the air blowing opening 44 (FIG. 7) of the first air blowing section 41 integral with the loading platen 70A to the air blowing opening 44 of the first air blowing section 41 integral with the loading platen 70B.

Figure 12:
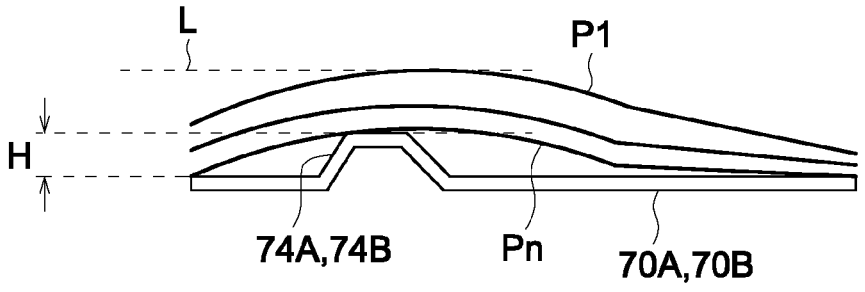
FIG. 12 is a diagram showing the ribs 74A and 74B provided on the loading platens 70A and 70B.
Figure 13:
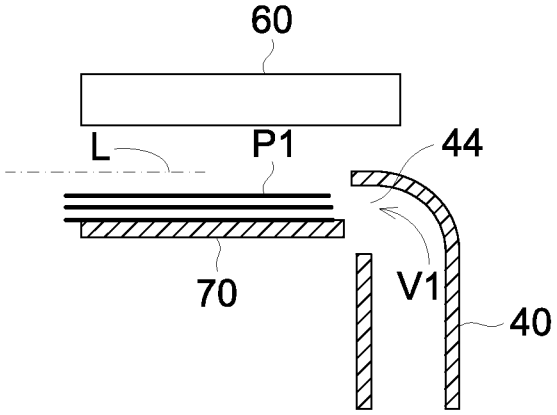
FIG. 13 is a schematic diagram showing the cross section close to the air blowing opening 44.

As shown in FIG. 12 that shows the ribs 74A and 74B along the direction of conveyance (indicated by arrow X), the sheet Pn in the lowest position is raised by the ribs 74A and 74B. Part of the first air flow V1*a* blown from the two opposing outlet 44 enters this clearance. Positive pressure is generated under the sheet Pn of the lowest position by the collision between two air flows, and the sheet Pn is pushed up and floated. The sheet P1 in the topmost position raised with the aid of this force of pushing is floated to the level L. As described above, the sheet below is raised by the second air flow V1*b* and the first air flow V1*a* blown by the floating of the ribs 74A and 74B shown in FIGS. 8*a*, 8*b*, 9*a* and 9*b*, and the sheet P1 of the topmost position reaches the level L essential for adsorption, whereby satisfactory sheet feed is performed.

As illustrated, the ribs 74A and 74B are formed by bending the loading platens 70A and 70B. However, the ribs 74A and 74B can also be produced using the members different from those of the loading platens 70A and 70B. For example, the ribs 74A and 74B can be manufactured using an elastic member.

When the height H of the ribs 74A and 74B is more than 2.0 mm, very satisfactory sheet feed was performed. If the ribs 74A and 74B are excessively high, the sheet may be bent. The height H is preferably kept at 10 mm or less.

Table 1 shows the result of the sheet feed test conducted by variously changing the height H of the ribs 74A and 74B.

TABLE 1

| Height H | Result | Remarks |
|---|---|---|
| 1.2 mm | C | Sheet feeding failure. Three remaining sheets failed to float. |
| 2.0 mm | B | Successful sheet feeding. However, there was a sheet feeding delay of about one second, due to the delayed floating of the final sheet. |
| 2.5 mm | A | Successful sheet feeding. |
| 3.0 mm | A | Successful sheet feeding. |
| 3.5 mm | A | Successful sheet feeding. |
| 4.5 mm | A | Successful sheet feeding. |
| 5.0 mm | B | Successful sheet feeding. However, when 500 sheets were stacked, the final sheet was scratched by protrusions. |

As shown in Table 1, no-feed failure, i.e., paper feed failure occurred when the height H was 1.2 mm. The sheets in the lower position were bent when the height H was 5.0 mm.

In the sheet feed test of Table 1, the ribs 74A and 74B were formed by bending the loading platens 70A and 70B made of sheet metal.

When a rubber member was used to form the ribs 74A and 74B, satisfactory sheet feed operation was performed without sheets being bent, while the height H of the ribs 74A and 74B was 10 mm or less.

In the present invention, sheets can be separated from one another and can be fed out one by one by the sheet feed method wherein the sheets are raised using only the ribs 74A and 74B without the loading platens 70A and 70B being provided with a penetration 71, and the sheet P1 on the topmost position is floated to the level L required for adsorption of the sheet P1

In the present embodiment, the loading platen is provided with penetrations, and using the airflow blown to both sides of the loaded sheet bundle, air is blown to the sheets upward from the bottom so that air pressure is produced between the clearance between the bottom of the sheet and loading platen, whereby sheet lifting force is generated. Further, in the present invention, the loading platen is provided with ribs in the direction perpendicular to the opposing air blowing openings, and where airflow is blown, air pressure is produced in the clearance between the sheet bottom and loading platen, whereby sheet lifting force is generated.

The aforementioned arrangement ensures that even a very small number of large-sized sheets of thick paper remaining on the bottom of the loaded sheet bundle can be effectively lifted, and therefore, prevents adsorption failure that may occur when there is a reduction in the number of sheets on the loading platen. These advantages of the present invention provide a low-cost sheet feeding apparatus of compact and lightweight structure that ensures stable feed of the sheets of any type completely free from any possibility of no-feed failure, as well as an image forming apparatus provided with the aforementioned sheet feeding apparatus.

What is claimed is:

1. A sheet feeding apparatus comprising:

a loading platen on which sheets are loaded;

a first air blowing section which blows air to a lateral surface of a loaded sheet bundle loaded on the loading platen to float up a sheet;

a second air blowing section which blows air to a leading edge of the loaded sheet bundle to separate the sheet;

an adsorption/conveyance mechanism which adsorbs and conveys a top most sheet floated by air flow blown by the first air blowing section and separated by the air blow from the second air blowing section; and a driving section moving the loading platen up and down, wherein the first air blowing section includes an air blowing opening facing the lateral surface of the loaded sheet bundle and blowing air to the lateral surface from a perpendicular side to a conveying direction, wherein the air blowing opening is formed so that a first air flow flows above the loading platen and a second air flow flows below the loading platen when the loading platen reaches a highest position by the driving section, and wherein the loading platen is provided with a penetration through which the second air flow flows from below to above the loading platen to float up a sheet.

2. The sheet feeding apparatus of claim 1, wherein a rib is formed in a direction perpendicular to the conveying direction at a position where the first air flow flows out from the air blowing opening, on an upper surface of the loading platen.

3. The sheet feeding apparatus of claim 2, wherein the rib extends from one side of the blowing opening toward the other side in the direction perpendicular to the conveying direction.

4. The sheet feeding apparatus of claim 1, wherein the first air blowing section includes a lateral edge regulating member regulating a side edge of a sheet and forming the air blowing opening.

5. An image forming apparatus comprising:

a sheet feeding apparatus including, a loading platen on which sheets are loaded, a first air blowing section which blows air to a lateral surface of a loaded sheet bundle loaded on the loading platen to float up a sheet, a second air blowing section which blows air to a leading edge of the loaded sheet bundle to separate the sheet, an adsorption/conveyance mechanism which adsorbs and conveys a top most sheet floated by air flow blown by the first air blowing section and separated by the air blow from the second air blowing section, and a driving section moving the loading platen up and down, wherein the first air blowing section includes an air blowing opening facing the lateral surface of the loaded sheet bundle and blowing air to the lateral surface from a side perpendicular to a conveying direction, wherein the air blowing opening is formed so that a first air flow flows above the loading platen and a second air flow flows below the loading platen when the loading platen reaches a highest position by the driving section, and wherein the loading platen is provided with a penetration thorough which the second air flow flows from below to above the loading platen to float up a sheet; and an image forming section forming image on a sheet fed out from the sheet feeding apparatus.

6. The image forming apparatus of claim 5, wherein a rib is formed at a position where the first air flow flows out from the of air blowing opening in a direction perpendicular to the conveying direction, on an upper surface of the loading platen.

7. The image forming apparatus of claim 6, wherein the rib extends from one side of the blowing opening toward the other side in a direction perpendicular to the conveying direction.

8. The image forming apparatus of claim 5, wherein the first air blowing section includes a lateral edge regulating member regulating a side edge of a sheet and forming the air blowing opening.

* * * * *